US008733022B2

(12) United States Patent
Sonnek et al.

(10) Patent No.: US 8,733,022 B2
(45) Date of Patent: May 27, 2014

(54) INTUITIVE EXTERIOR DOOR HANDLE

(75) Inventors: Tom F. Sonnek, Reinbeck, IA (US); Lior Tikozenski, Hagalil (IL)

(73) Assignee: Trimark Corporation, New Hampton, IA (US)

( * ) Notice: Subject to any disclaimer, the term of this patent is extended or adjusted under 35 U.S.C. 154(b) by 171 days.

(21) Appl. No.: 13/157,850

(22) Filed: Jun. 10, 2011

(65) Prior Publication Data

US 2011/0302842 A1 Dec. 15, 2011

Related U.S. Application Data

(60) Provisional application No. 61/354,085, filed on Jun. 11, 2010.

(51) Int. Cl.
*E05F 15/02* (2006.01)

(52) U.S. Cl.
USPC ..... 49/280; 49/279; 49/460; 296/146.4

(58) Field of Classification Search
USPC ..... 49/279, 280, 394, 460; 296/146.4; 292/336.3, 57, 58, 63, 66, DIG. 31; 70/208, 210, 215–217, 224, 278.7, 70/279.1
See application file for complete search history.

(56) References Cited

U.S. PATENT DOCUMENTS

| | | | | |
|---|---|---|---|---|
| 1,653,487 | A * | 12/1927 | White | 70/128 |
| 4,524,590 | A * | 6/1985 | Budish | 70/129 |
| 4,984,385 | A | 1/1991 | DeLand | |
| 6,135,513 | A | 10/2000 | Hamada et al. | |
| 6,546,765 | B1 * | 4/2003 | Linares | 70/210 |
| 6,550,831 | B2 * | 4/2003 | Rizk | 292/336.3 |
| 6,561,557 | B2 * | 5/2003 | Choi | 292/336.3 |
| 6,715,807 | B2 * | 4/2004 | Molzer | 292/336.3 |
| 6,802,544 | B1 * | 10/2004 | Lane | 292/336.3 |
| 8,002,328 | B2 * | 8/2011 | McKee et al. | 296/146.4 |
| 8,091,933 | B1 * | 1/2012 | Hemann et al. | 292/198 |
| 8,171,673 | B2 * | 5/2012 | Helms | 49/341 |
| 2007/0130837 | A1 * | 6/2007 | Kusunoki | 49/460 |
| 2007/0132273 | A1 | 6/2007 | Suzuki et al. | |
| 2009/0267354 | A1 * | 10/2009 | Donaldson et al. | 292/2 |
| 2010/0123322 | A1 | 5/2010 | Baragano Gonzalez | |
| 2011/0144868 | A1 * | 6/2011 | Tezak et al. | 701/49 |
| 2012/0167476 | A1 * | 7/2012 | Weinerman et al. | 49/460 |

OTHER PUBLICATIONS

Trimark Corporation et al., PCT/US2011/039987, International Search Report and The Written Opinion of the International Searching Authority, mailed Feb. 27, 2012, 12 pages.

* cited by examiner

*Primary Examiner* — Katherine Mitchell
*Assistant Examiner* — Abe Massad
(74) *Attorney, Agent, or Firm* — McKee, Voorhees & Sease, P.L.C.

(57) ABSTRACT

An intuitive exterior door handle assembly is provided for a heavy duty power assisted vehicle door for opening and closing the door. The exterior handle assembly pivots about an axis for movement between pushed in and pushed out positions to actuate the power assist unit in opposite directions and thereby close and open the door, respectively. A switch or valve assembly controls actuation of the power assist unit in response to pulling or pushing the door handle so as to open and close the door. An override system is built into the handle assembly to actuate the power unit without pivoting the handle. The assembly and override system mount through a single common hole in the door. In the method of operating the vehicle door, the exterior handle is pushed inwardly to close the door and pulled outwardly to open the door through retraction and extension of the power assist assembly.

18 Claims, 11 Drawing Sheets

INTUITIVE EXTERIOR DOOR HANDLE

CROSS-REFERENCE TO RELATED APPLICATIONS

This application claims priority under 35 U.S.C. §119 of a provisional application Ser. No. 61/354,085 filed Jun. 11, 2010, and which application is hereby incorporated by reference in its entirety.

BACKGROUND OF THE INVENTION

Heavy duty armored vehicles, used for example, by the military, must be built to withstand forces far greater than encountered by conventional consumer cars and industrial trucks. The utilization of increasingly powerful explosive devices such as IED's, RPG's, and EFP's by hostile insurgent forces has compelled the defense industry to respond by deploying heavier armor on their tactical armored vehicles. While necessary to protect military personnel, heavier armor creates unique problems. The weight of heavily armored vehicle doors and ramps often exceeds 200 lbs., and in some instances, may exceed 1,000 lbs. To open and close such doors or ramps requires assistance from electric, pneumatic, or hydraulic powered units. Such power assisted doors and ramps are known in the industry. Prior art powered doors require separate mechanical and electrical systems, with separate control handles and/or switches for the door and locks, which result in non-integrated and complicated door functions. These complications unnecessarily lead to increased difficulties and time in opening and closing the heavy doors of these armored vehicles, particularly in emergency situations.

Most often a rotating lever-type handle is used in these applications to mechanically unlatch a rotary cam latch, bolt-action latch and/or rotor and catch spring return latches in a rotational motion about a horizontal axis.

The power assist function is initialized when the all-mechanical latches in the system are mechanically unlatched. This is accomplished in one of two ways:

1) The same lever that mechanically unlatches the system hits an electrical switch at the end of its rotational travel in the same axis of motion and requires the operator to hold the lever handle at this position to keep the power assistance device engaged, or
2) A separate spring loaded, normally open, electrical switch is manually triggered by the operator to engage the power assistance device and switch must remain triggered to keep the power assistance device engaged.

Neither of these methods mimics an intuitive control motion to power the door or ramp open and closed in the direction of the open and closing motion.

An external mechanical override is often included in a powered door system to allow the door to be opened from the outside and free the occupants in case of emergency. The override can be operated with the internal door handle that has been removed from another vehicle, or another tool can be used to operate the override. The handle is inserted onto the override shaft and rotated to open the door. This feature requires an additional protruding shaft to the exterior of the vehicle and in the case of armored vehicles, it requires an additional hole to be made through the armor, apart from the hole for the handle assembly.

Accordingly, a primary objective of the present invention is the provision of an improved intuitive motion control system for heavy, power assisted, vehicle doors, ramps, and hatches.

Another objective of the present invention is the provision of a mechatronic assembly which simplifies opening and closing of doors from the exterior on heavily armored vehicles.

A further objective is the provision of an exterior door handle having a built-in mechanical override feature.

Another objective of the present invention is the provision of an armored vehicle door having an intuitive exterior door control system for locking, unlocking, latching, unlatching, opening and closing the door, ramp or hatch.

A further objective of the present invention is the provision of an improved method of operating a heavy duty vehicle door, ramp or hatch.

Still another objective of the present invention is the provision of an improved power assisted door with a safe and durable handle assembly for opening and closing the door from outside the vehicle.

Another objective of the present invention is the provision of an improved exterior control system for operating an armored vehicle door or ramp in a minimal amount of time.

A further objective of the present invention is the provision of an improved power assist door handle assembly which only requires a single mounting hole through the door for both the handle assembly and override mechanism.

These and other objectives will become apparent from the following description of the invention.

SUMMARY OF THE INVENTION

The intuitive motion control system for operating a heavy armored vehicle door or ramp includes a power assist module that can simply, safely and quickly open and close the door with intuitive motions. The system connects the operation of the main latch, the combat or blast locks, and the power assist open/close unit to the outside door handle and to an exterior emergency egress override system for first responders. The simple functionality of the intuitive system reduces complexity for the soldiers and promotes safety and reliability in the field.

The control system includes an exterior door handle assembly to articulate the door, ramp or hatch between open and closed positions by actuating the power assist unit, as well as actuating the blast locks and door latch. The handle lever motion coincides with the desired direction of door travel so as to be intuitive for the soldier's opening and closing the door of the heavily armored vehicle. The system is designed to withstand the rigors of battle and rugged off-road abuse for easy door operation by a $5^{th}$ percentile female soldier or a $95^{th}$ percentile male soldier. A mechanical override is built into the handle assembly, such that only a single hole exists in the door for mounting the primary and override door control mechanisms.

This invention combines an intuitive push-pull exterior control handle with a mechanical emergency override. The invention is operated by pushing or pulling on the handle to trigger a switch or control valve which powers the door in the intended direction. The handle returns to a center or neutral position when released and the door motion stops. A rotating mechanical emergency override is built into the handle. The handle assembly is installed using a single mounting hole through the door, which may be a keyed or shaped hole, to accommodate both the handle assembly and the override mechanism, the same size hole through the armor as a standard rotating handle.

DETAILED DESCRIPTION OF THE PREFERRED EMBODIMENTS

Figure 22:
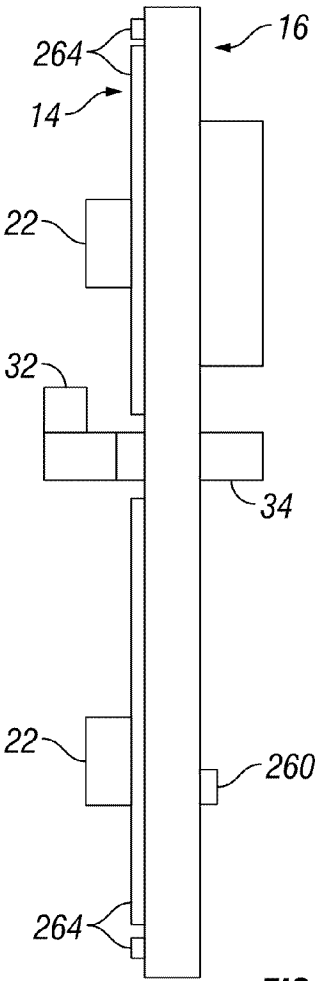
FIG. 22 is a schematic side view of the door shown in FIG. 21.
Figure 21:
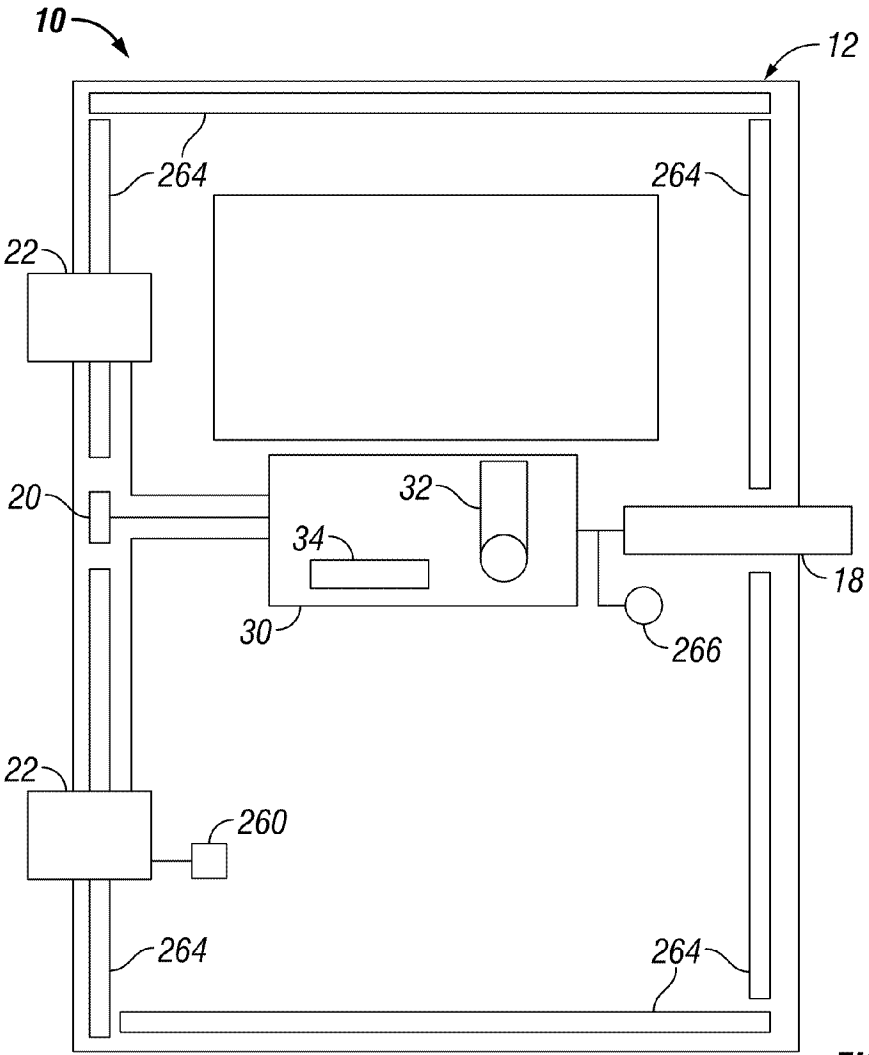
FIG. 21 is a schematic view of a heavy door showing the exterior handle assembly of the present invention, as well as an interior handle assembly, latch assembly, lock assembly, and power assist assembly.

As shown in FIG. 21, the intuitive control system 10 of the present invention is intended for use on a heavy door, ramp or hatch 12 of a vehicle, such as an armored military vehicle. The terms door, ramp and hatch are used synonymously in this description. As shown in FIG. 22, the door 12 has an interior side 14 and an exterior side 16. As shown in FIGS. 21 and 22, a power assist unit 18 is mounted within the door 12. The power assist unit 18 has opposite ends connected to the door 12 and the door frame, and is extensible through electric, hydraulic, or pneumatic means so as to move the door 12 between open and closed positions. The door 12 may include a latch assembly 20 which is operable between a latched position to retain the door in a closed position and an unlatched position to allow the door to open. The door 12 also includes a blast or combat lock assembly 22 moveable between locked and unlocked positions for additional door security.

A control handle module 30 is provided on the door 12 and operably connected to the power assist unit 18, the latch assembly 20, and the blast lock assembly 22. The handle module 30 includes an interior joystick handle assembly 32 and an exterior handle assembly 34. A mounting plate supports various linkage components within the door that tie together the joystick module 32, the outside handle assembly 34, the power assist unit 18, the latch assembly 20, and the blast block assembly 22

The structure, function and operation of the interior handle assembly 32, latch assembly 20, and lock assembly 22 are described in co-pending patent application Ser. No. 12/712,766 filed on Feb. 25, 2010 and entitled INTUITIVE CONTROL SYSTEM FOR POWER ASSISTED VEHICLE DOORS, which is incorporated herein by reference. This system includes an emergency access shaft 260, safety contact strips 264, and an emergency stop button 266, as shown in FIGS. 21 and 22.

The present invention is directed to the exterior intuitive door handle assembly 34.

The exterior handle assembly 34 includes a housing 40 which mounts on the exterior of the vehicle door via a tube or collar 42 and a nut 44. A shaft 46 extends through the housing 40 and through the tube 42 and bushings 43, as best seen in FIGS. 4-6 and 11. A pin 48 extends through the upper end of the shaft 46 within the housing 40.

Figure 10:
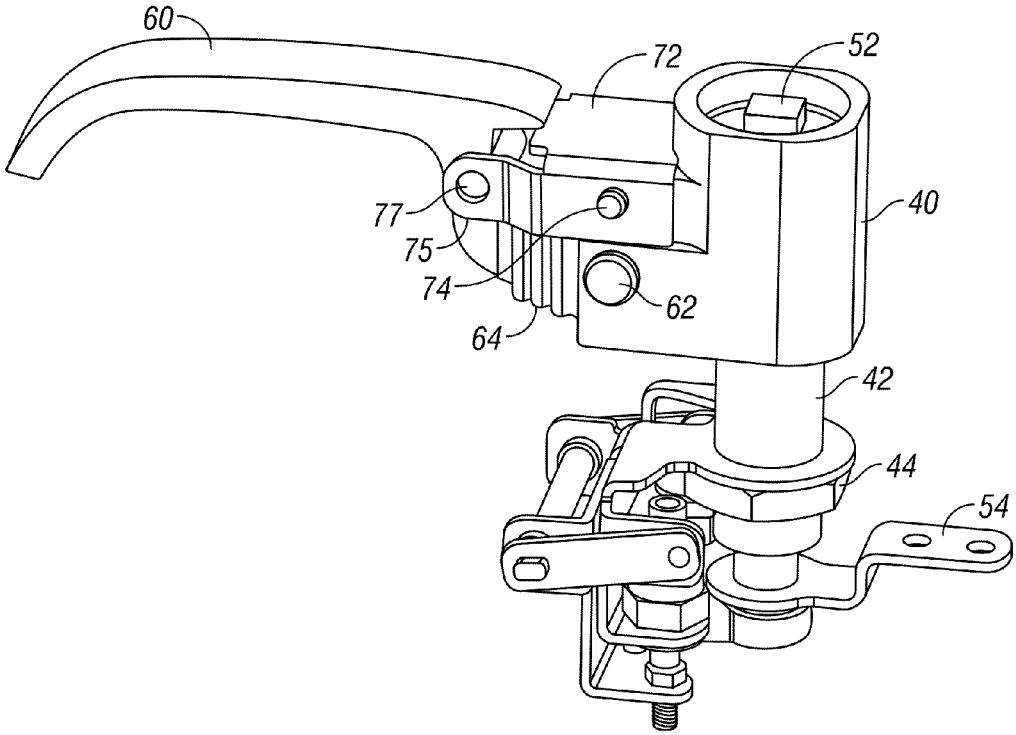
FIG. 10 is a perspective view of the handle assembly shown in FIG. 1 with one embodiment of a switch assembly included.
Figure 11:
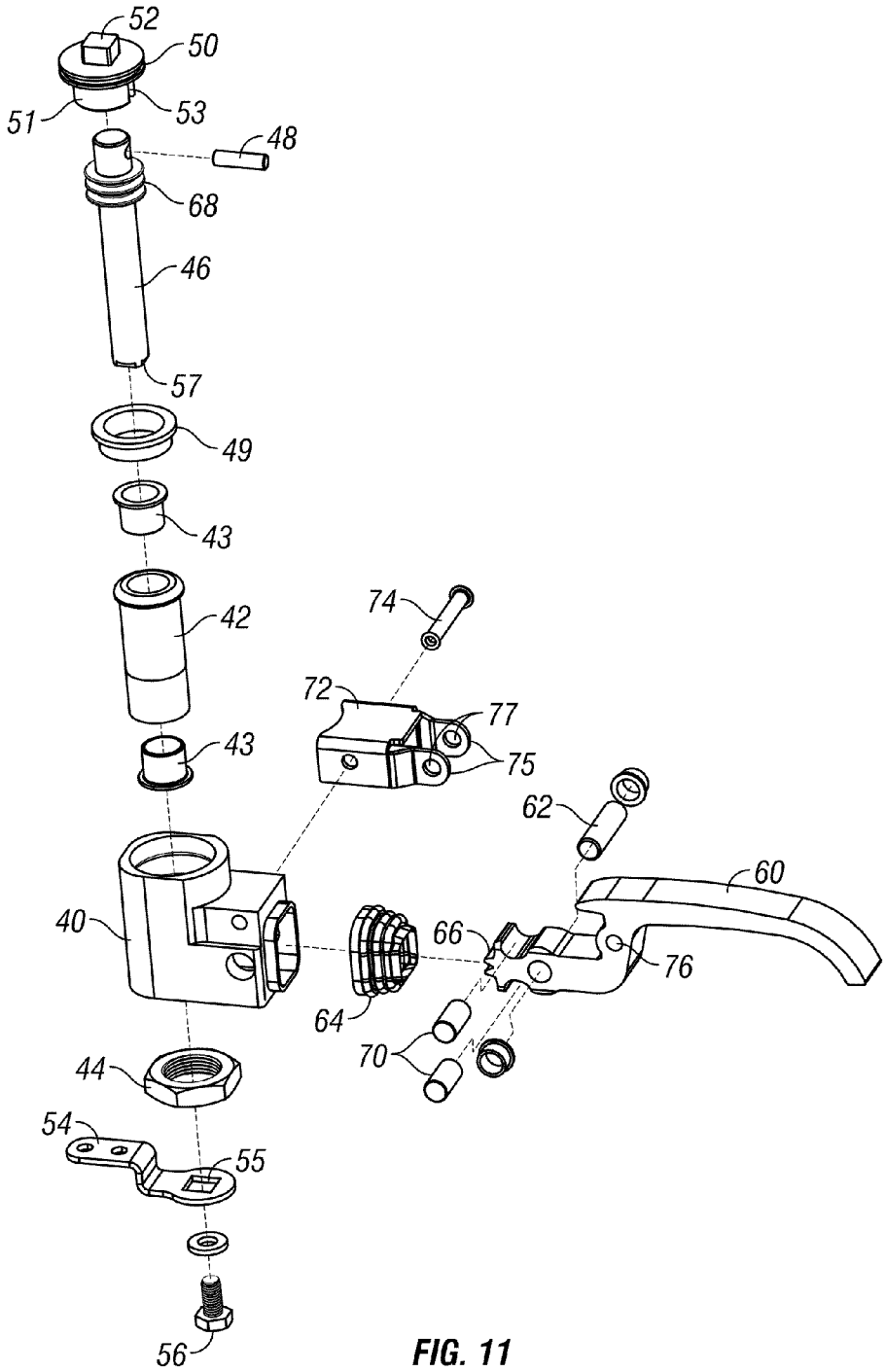
FIG. 11 is an exploded perspective view showing the components of the handle assembly of FIG. 1.

An override cap 50 is received over the upper end of the shaft 46, and includes a lower annular lip or rim 51 with a slot 53 for receiving the edge of a seal 49. The top of the cap 50 includes a stub drive shaft 52 which resides within the outer recess of the housing 40, as seen in FIG. 10. The override cap 50 is retained in the housing 40 in any convenient manner, such as a snap ring. A lever 54 with a square hole 55 is mounted to the square lower end 57 of the shaft 46, which extends beyond the bushing 42, using a bolt 56, as best seen in FIG. 11. The lever 54 is connected to the latch assembly 20 and to the lock assembly 22 by appropriate linkage (not shown). It is understood that the lever 54 may take other forms from that shown in the drawings, and may translate motion from the handle assembly in different directions.

Figure 1:
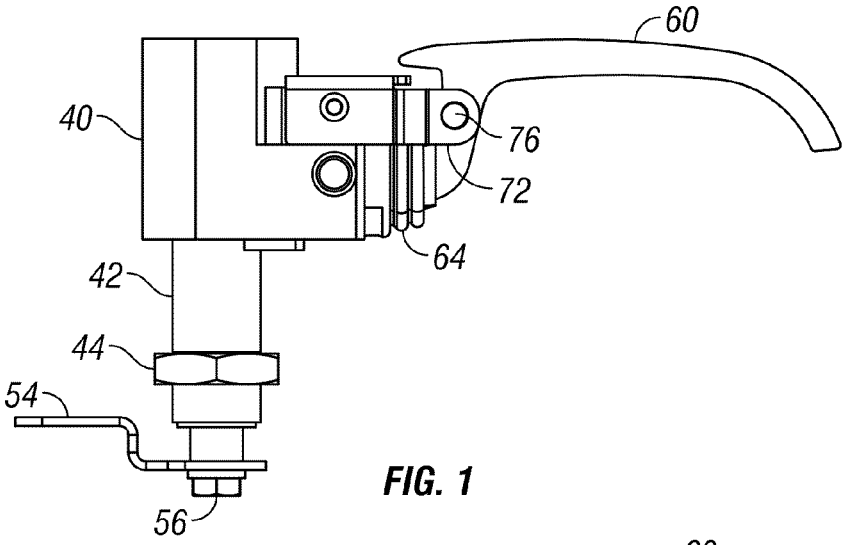
FIG. 1 is side elevation view of one embodiment of the handle assembly according to the present invention in a neutral position, and with the switch assembly removed for clarity.
Figure 2:
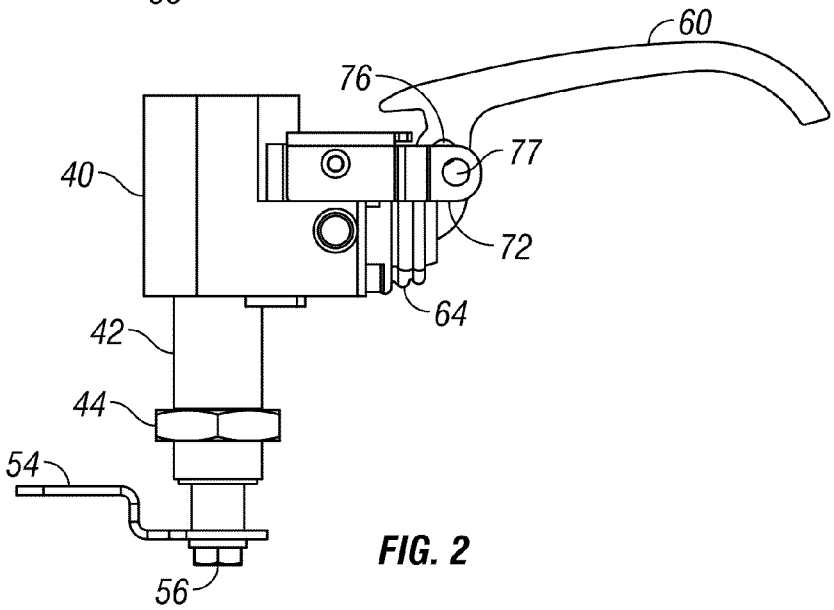
FIG. 2 is a side elevation view of the handle assembly of FIG. 1 with the lever pulled outwardly to the open position.
Figure 3:
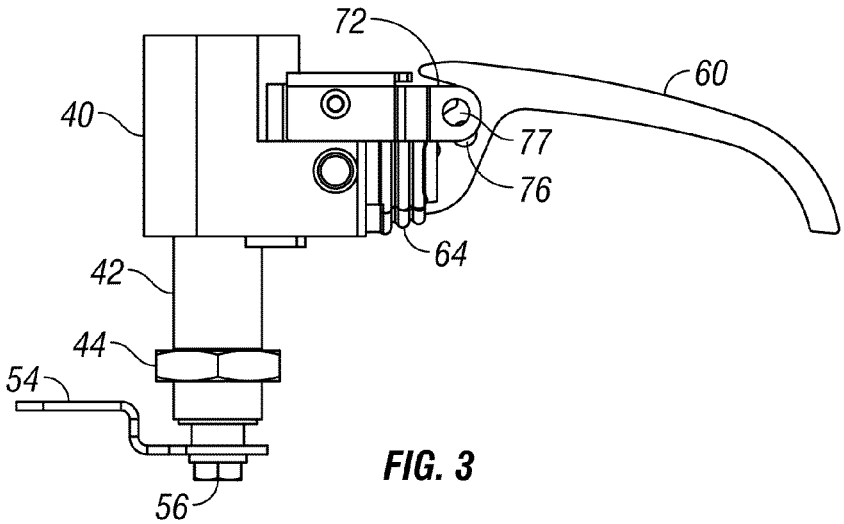
FIG. 3 is a side elevation view of the handle assembly of FIG. 1 with the lever pushed inwardly to the close position.
Figure 4:
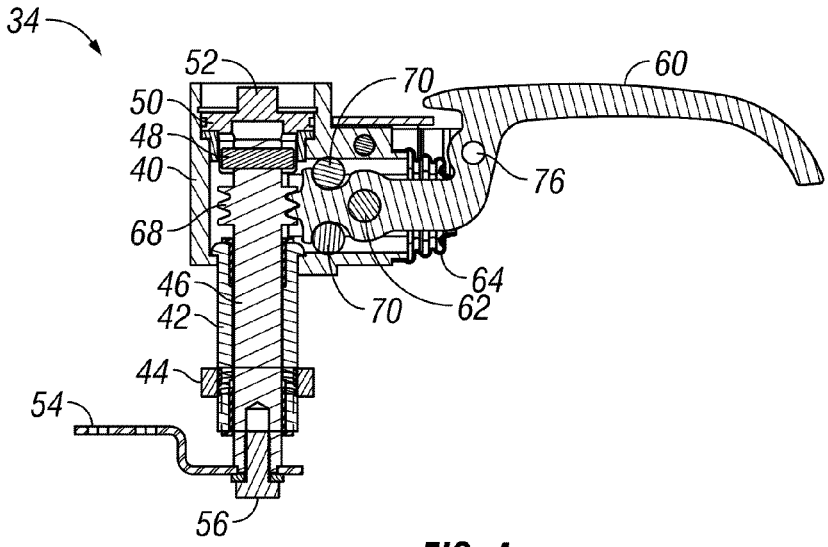
FIG. 4 is a sectional view showing the neutral position of the intuitive handle assembly of FIG. 1.
Figure 5:
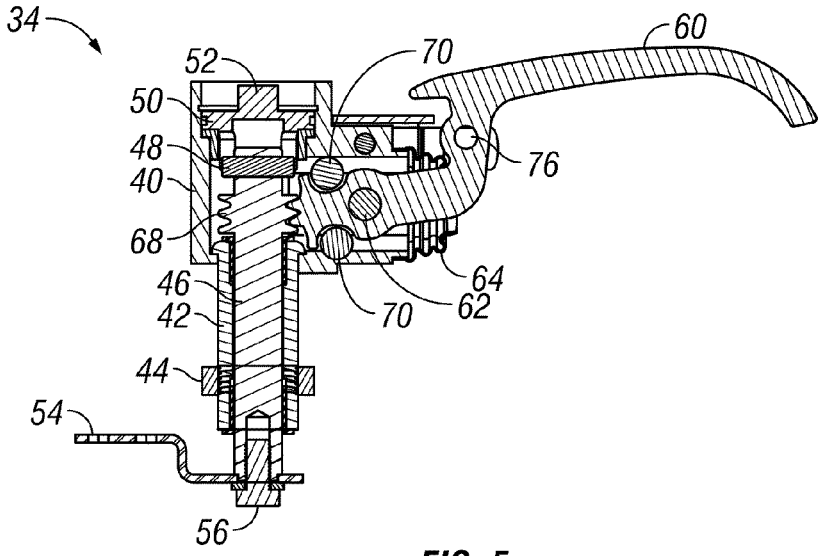
FIG. 5 is a sectional view showing the handle assembly of FIG. 2 with the lever pulled outwardly to the door-opening position.
Figure 6:
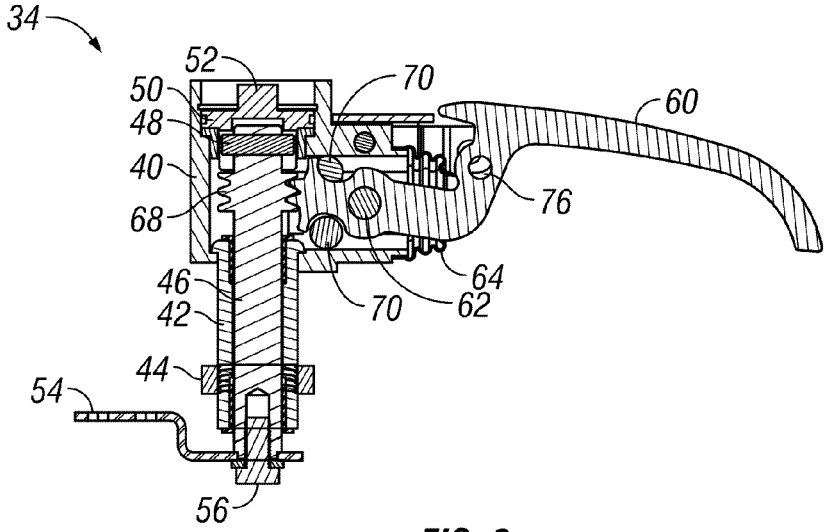
FIG. 6 is a sectional view showing the lever of the handle assembly of FIG. 3 pushed inwardly to the door-closing position.
Figure 7:
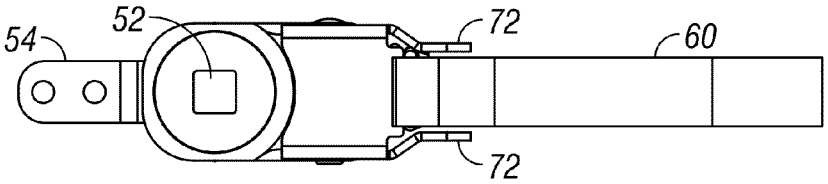
FIG. 7 is a top plan view of the handle assembly of FIG. 1.
Figure 8:
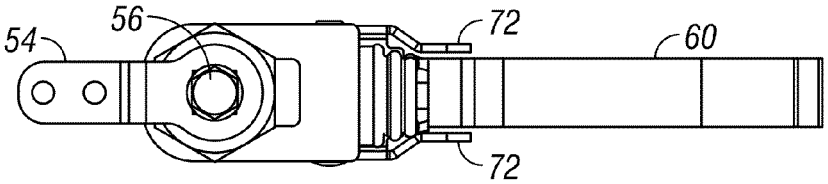
FIG. 8 is a bottom plan view of the handle assembly of FIG. 1.
Figure 9:
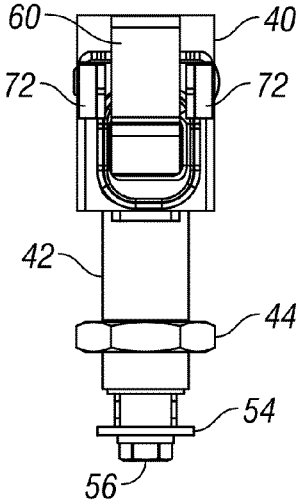
FIG. 9 is a right end view of the handle assembly of FIG. 1.

The exterior handle assembly 34 also includes a lever 60 pivotally mounted to the housing 40 via a pin or axle 62. When the handle assembly 34 is mounted to the door, the axle 62 is oriented vertically, such that the lever pivots about a vertical axis between the pulled out open position away from the door, as shown in FIGS. 2 and 5, and the pushed in closed position toward the door, as shown in FIGS. 3 and 6. A flexible bellows 64 mounted to the housing 40 and through which the lever 60 extends minimizes ingress of contaminants into the housing 40. The end of the lever 60 within the housing 40 includes a plurality of teeth 66 which mesh with a plurality of teeth 68 on the shaft 46, so as to form a rack and pinion type assembly. Preferably, the teeth 66 extend 360° radially, in either an annular or rotary orientation. A pair of elastomeric members 70 normally bias the lever to a neutral position, as shown in FIG. 1. Thus, pivotal movement of the lever 60 about the axle or pin 62 imparts axial movement to the shaft 46 for sliding movement through the tube 42. The lever 54 attached to the end of the shaft 46 is operatively connected to the power assist unit 18 of the vehicle door 12, as well as to the latch assembly 20 and lock assembly 22, in any convenient manner. Thus, pulling the handle lever 60 outwardly unlatches the latch assembly 20, unlocks the lock assembly 22, and actuates the power assist unit 18 to open the vehicle door. Pushing the lever 60 inwardly actuates the power assist unit to close the vehicle door, which latches and locks automatically as in Applicant's co-pending application Ser. No. 12/712,766. Thus, the motion of the lever 60 intuitively corresponds to the motion of the door.

A yoke 72 is mounted to the housing 40 via a rivet 74. The yoke 72 has a pair of ears 75 which straddle the lever 60. A padlock can be placed through a hole 76 in the lever 60 and aligned holes 77 on the yoke 72 to secure the handle assembly 10 against unauthorized opening of the door.

In operation, the invention uses the shaft 46 with rotary rack gear teeth 68 and the pinion gear 66 on the handle lever 60 to transfer movement to operate the control switches or valves for the power assist unit 18, and the lock and latch assemblies 22, 20 (if present on the door). The handle lever 60 is centered by the two resilient members 70 and the travel is limited by stops built into the handle assembly 34. An upper stop is formed by the upper end of the slot 53 of the cap 50, which is engaged by the pin 48 when the handle lever 60 is pushed inwardly, as shown in FIG. 6. A lower stop is defined by the upper end of the bushing 42, which is engaged by the lower-most teeth 68 when the handle lever 60 is pulled outwardly, as seen in FIG. 5. When the handle is operated, movement is transferred through the gears 66, 68 to provide inward or outward shaft movement. The rotary rack gear on the shaft 46 allows the shaft to rotate when driven with the mechanical override through the pressed in pin 48. The mechanical override uses the slot 53 in the cap 50 to drive the shaft 46 in an emergency situation, and allows the shaft 46 to move in or out in normal operation while the override remains in a fixed position.

In an emergency, the interior handle of the door 12 may be removed from another similarly equipped armored vehicle and used as an emergency latch release rescue wrench to allow authorized personnel to disengage the combat locks 22 from the outside and open the door 12 on a vehicle that is damaged or whose personnel have been disabled. The rescue handle or inside joystick is placed over the emergency exterior override stub shaft 52, with the end of the joystick having a shaped drive recess to matingly engaging the end of the stub shaft 52, and rotated to turn the shaft 46 and override lever 54, and thereby mechanically disengage the latches 20 and/or locks 22, and open the door 12. The power assist unit 18 is then operative during emergency opening of the door 12 from outside the vehicle by pulling outward on the lever 60, if power is available. If the assist unit 18 is inoperative, the door can be manually opened in an emergency after the latch and lock assemblies 20, 22 are disengaged.

Figure 23:
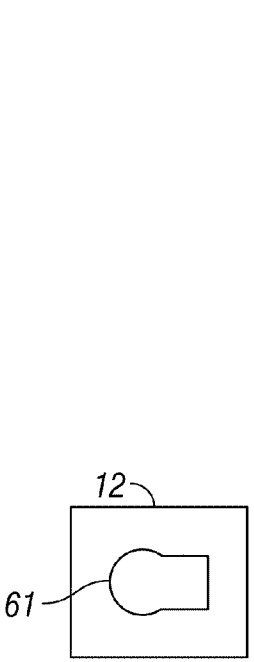
FIG. 23 is a plan view of the keyed hole in the armored door for mounting the handle assembly having the override mechanism, according to the present invention.

Thus, the override mechanism is built into the handle assembly, so that the combination handle assembly and override mechanism only requires a single hole 61 in the door 12 for mounting as seen in FIG. 23. Preferably, the hole 61 is keyed or shaped to matingly receive the handle assembly housing 40. The co-axial arrangement of the handle shaft 46 and the override shaft 52 eliminates the need for a second hole in the door (as in a conventional handle with a separate override mechanism). It is appreciated that this feature of mounting through a single hole reduces the overall number of holes to be made in the armor of the door to which the assembly 10 is mounted, thereby increasing the overall ballistic capability of this armor. It is also appreciated that the assembly 10, the handle lever 60 and the override shaft 52 are configured for operation independently of one another, such that, the handle lever 60 can be operated without operating the override shaft 52, and vice versa.

FIGS. 12-16 show one example of a switch assembly 80. The switch assembly 80 is mounted on the shaft 46 via a mounting bracket 82 and a retaining bolt 84 extending upwardly into the lower end of the shaft 46. An open switch 86 and a close switch 88 are mounted in the bracket 82 and retained by nuts 90, 92 respectively.

Figure 12:
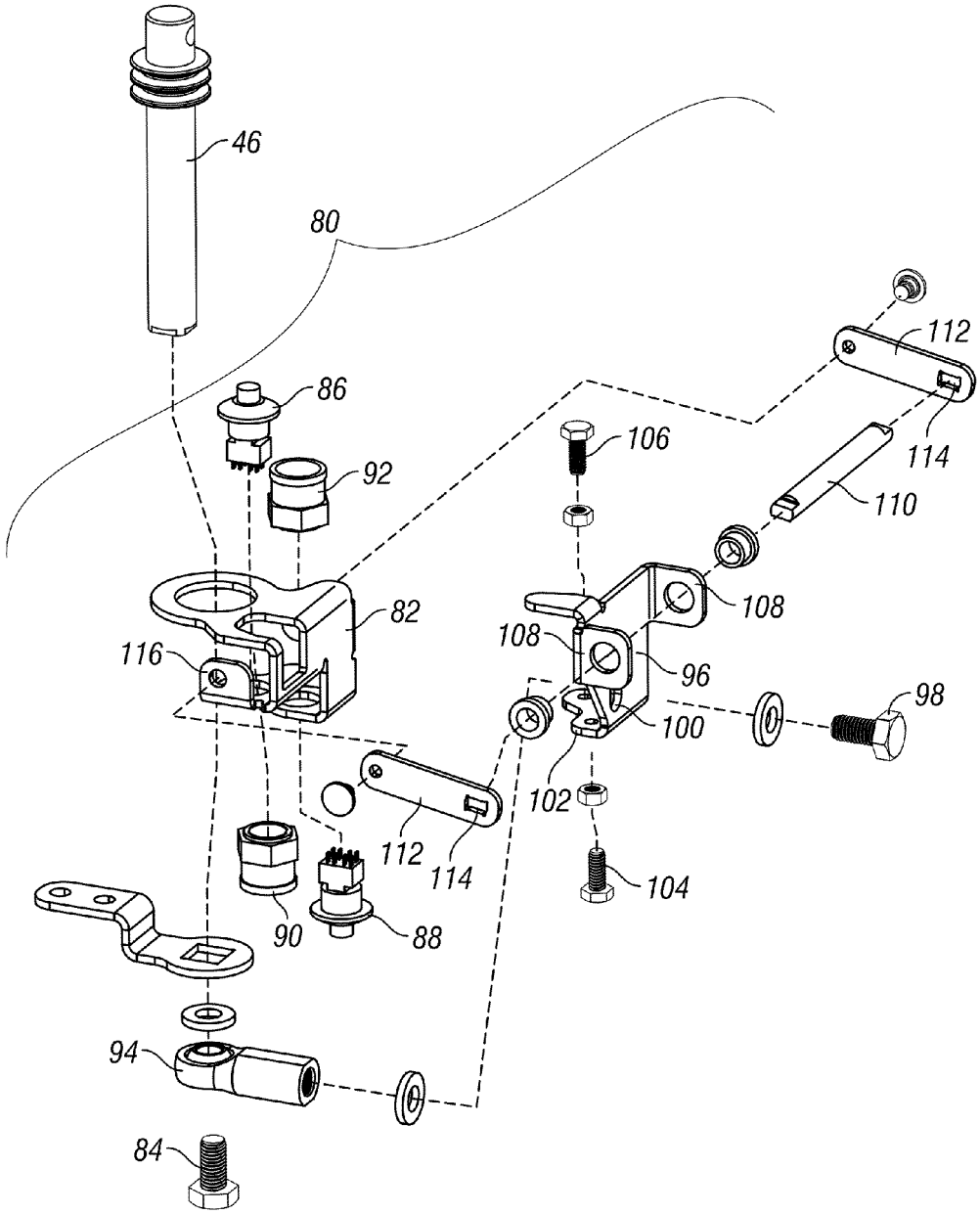
FIG. 12 is an exploded perspective view of the switch assembly for the handle assembly of FIG. 10.
Figure 13:
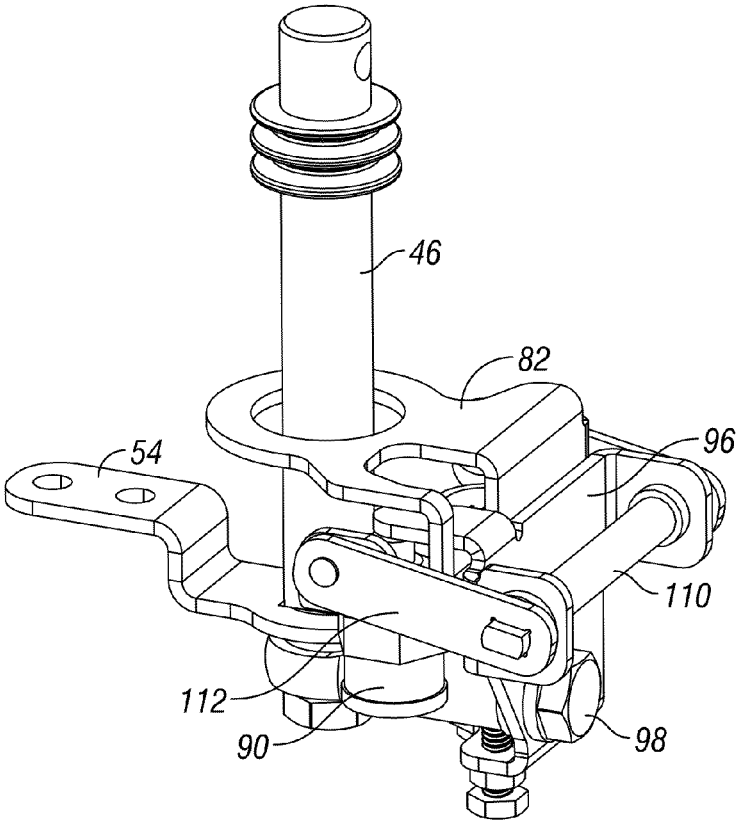
FIG. 13 is a perspective assembled view of the switch assembly.
Figure 14:
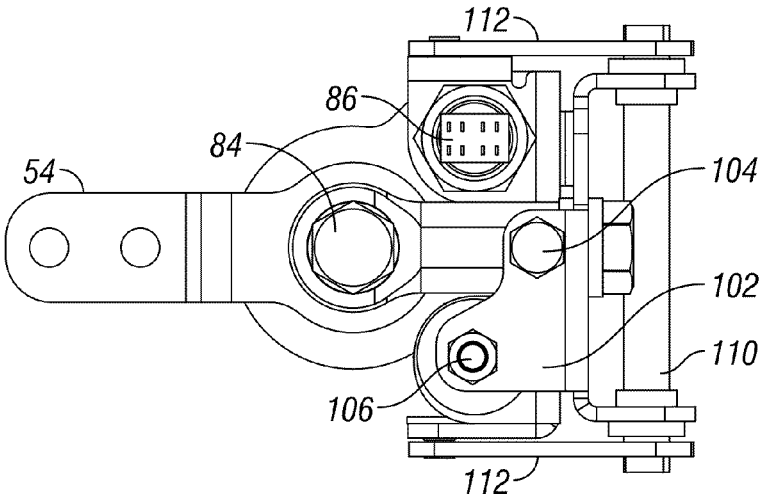
FIG. 14 is a bottom plan view of the switch assembly.
Figure 16:
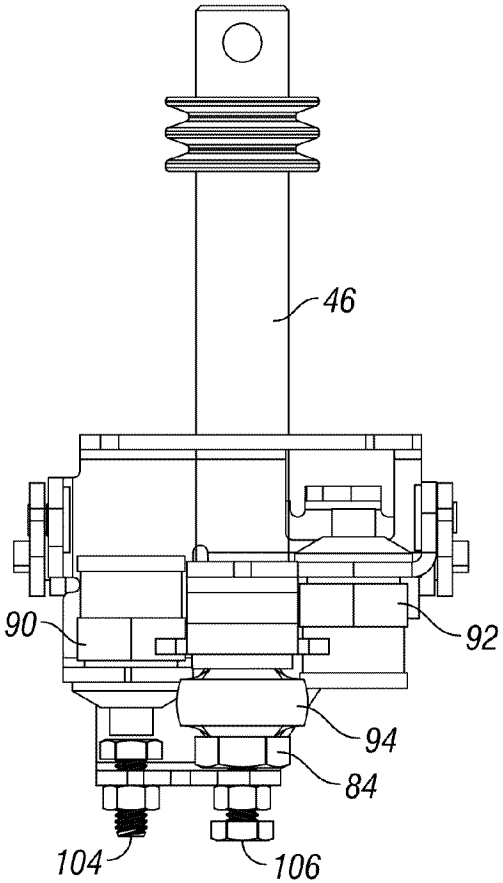
FIG. 16 is an end elevation view of the switch assembly.
Figure 15:
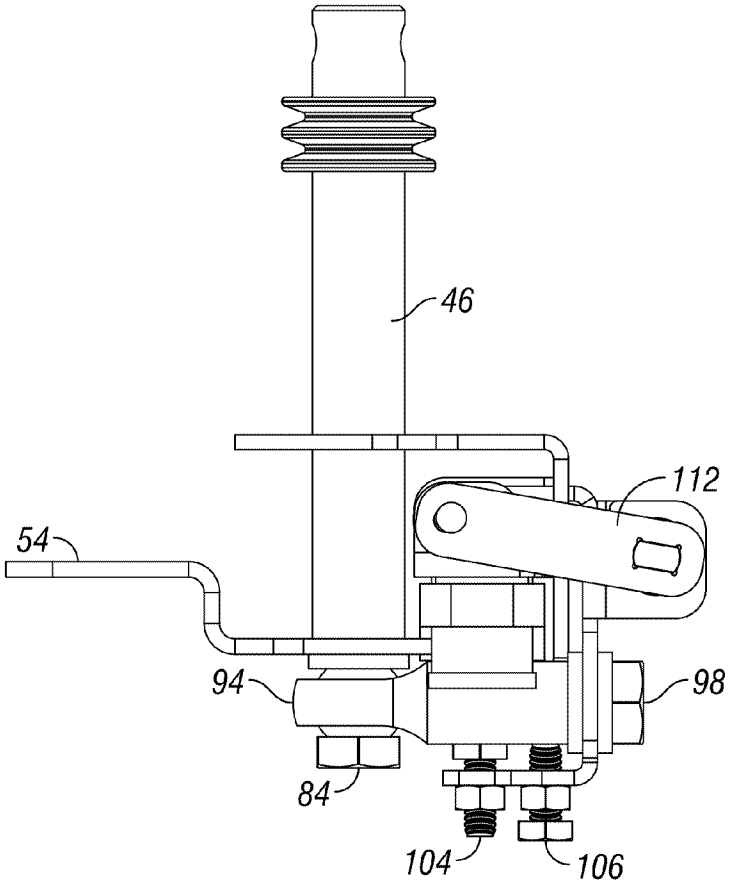
FIG. 15 is a side elevation view of the switch assembly.
Figure 17:
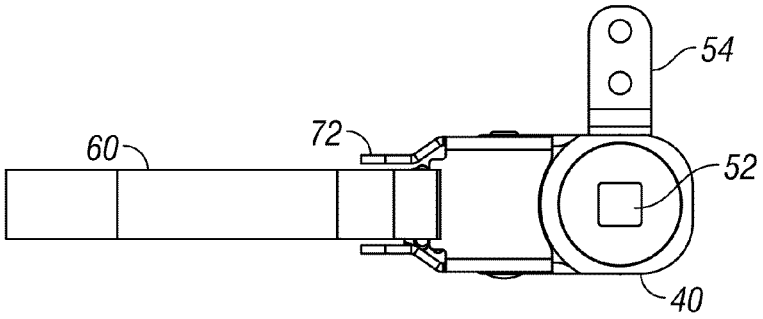
FIG. 17 is a top plan view of the handle assembly with the override lever rotated 90° counterclockwise.
Figure 18:
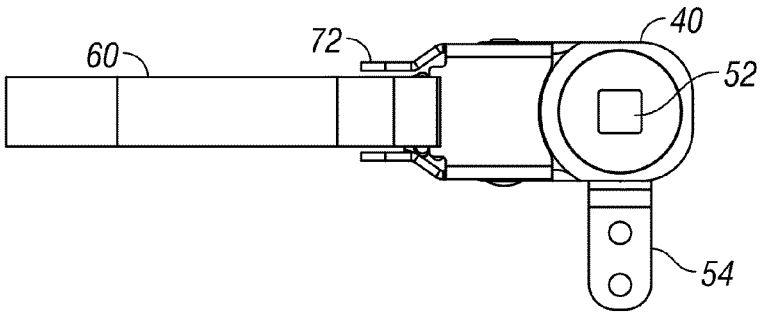
FIG. 18 is a top plan view similar to FIG. 17 with the override lever rotated 90° clockwise.
Figure 20:
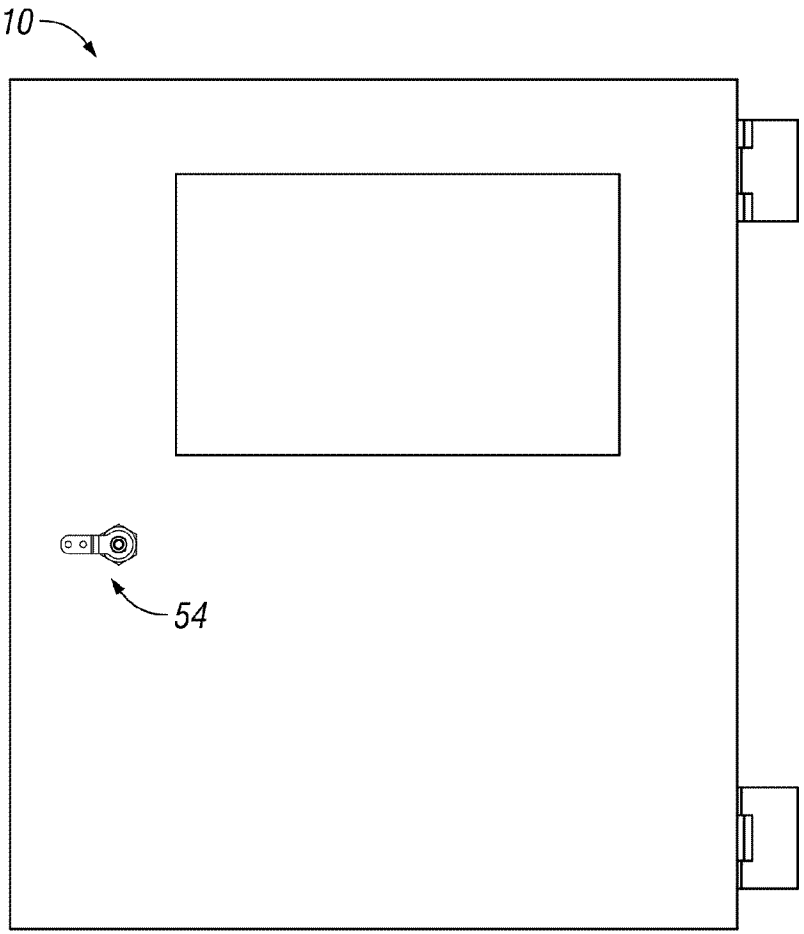
FIG. 20 is a schematic view of the inside of the heavy duty vehicle door with the handle assembly mounted thereon.
Figure 19:
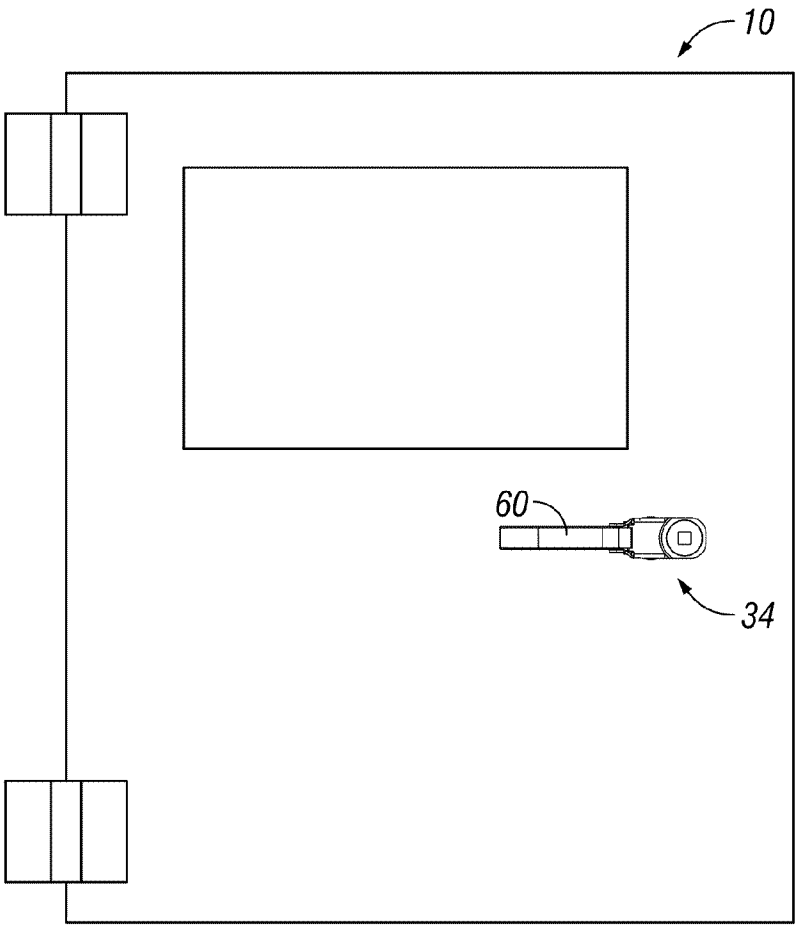
FIG. 19 is a schematic view of the outside or exterior of a heavy duty vehicle door with the handle assembly mounted therein.

A switch actuation rod 94 is mounted onto the retaining bolt 84. A switch actuation bracket 96 is secured to the rod 94 via a bolt 98 extending through a slot 100 in the bracket 96. The slot 100 allows for adjustment of the actuation bracket 96 relative to the switch mouthing bracket 82. The actuation bracket 96 includes a tab 102 (as seen in FIG. 12) with a pair of holes for receiving an open switch adjustment bolt 104 and a close switch adjustment bolt 106. The actuation bracket 96 also includes a pair of spaced apart tabs 108, each having a hole through which a pivot shaft 110 extends. A pair of pivot links 112 have keyed openings or slots 114 to receive the keyed ends of the pivot shaft 110. The opposite ends of the links 112 are bolted or pinned to tabs 116 on the mounting bracket 82.

In operation, the exterior handle 60 moves the shaft 46, as described above. The shaft 46 is attached to the rod 94, which in turn is connected to the actuation bracket 96, such that the bracket 96 moves inwardly and outwardly with the shaft 46. The movement of the actuation bracket 96 contacts one of the open or close switches 86, 88, so as to actuate the power assist unit 18, and thereby open and close the door 12. The open and close switches 86, 88 are offset so that switch 86 is actuated when the handle 60 is pulled outwardly, and switch 88 is actuated when the handle 66 is pushed inwardly.

For a door with electric inputs, the electronic door control system includes an intelligent control, a plurality of switch inputs operatively connected to the intelligent control, the plurality of switch inputs associated with state of a plurality of mechanical components of the power assisted door, and motor drive operatively connected to the intelligent control for providing opening and closing of the power assisted door. The intelligent control is configured to monitor status of the plurality of switch inputs and control the motor drive at least partially based on the status of the plurality of switch inputs.

In regards to either electronic or valve type inputs, several switches or valves may be used to determine the position or intended operation of a power assist system. The switches/valves are typically spring loaded plunger style mechanisms that indicate or control an either normally open or normally closed current. The input devices may be adjustable or offer several separate inputs to control speed or other functions. The use of contact, contact-less, or wireless inputs may be used where required to give the intended signals to a control module or valve bank to form the logic of a typical assist door system.

Flexible features within the system 10 allow the opening and closing speeds to be varied to match the need of the vehicle or mission. The speed can be profiled to slowly start, speed up in the middle of travel and slow down at the end of travel as another way to insure safe operation.

Because the motion of the exterior handle assembly intuitively leads to the motion of the hardware it controls, the system 10 is an intuitive motion control for assisting the powered opening and closing of the heavily armored doors and ramps used on today's military vehicles.

The intuitive door control system of the present invention can be further enhanced with an electronic control system, as described in co-pending application Ser. No. 12/712,794, entitled CONTROL SYSTEM FOR POWER-ASSISTED DOOR, filed on Feb. 25, 2010, and incorporated herein by reference.

Features of the invention:

1) The mechanical spring-loaded handle is normally in a centered or neutral position. Push the handle to close the door or pull the handle to open the door. The door motion stops when the handle is released or returned to the center position. The operation is more intuitive than a rotating door handle.
2) An electrical signal (or flow through a mechanical valve) to the motion control device for opening and closing the door is sent by mechanically actuating two normally open electrical switches (or valves) via a mechanical lever actuated by moving the handle in the axis perpendicular to its mounting plane.
3) The outside control handle includes a rotational mechanical emergency rescue feature. This feature is operated with an internal door handle from a similar vehicle.
4) This assembly uses the same size mounting hole as our current military exterior handle and eliminates the need for 2 holes though the door armor. It provides a more intuitive motion for controlling powered door systems and includes an emergency rescue feature.
5) The system includes a modular switch assembly located on the inside of the vehicle door.
6) The exterior portion is sealed to protect against ingress of dirt and moisture for more reliable operation.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A vehicle door, comprising:

a power assist unit to assist in opening and closing the door;

an exterior handle assembly including an exterior handle mounted on the door to actuate the power assist unit;

an override system built into the handle assembly and accessible from outside the vehicle to actuate the power assist unit to open the door;

a unitary shaft extending into the door and having a single exterior end residing outside the door and within the exterior handle assembly, and the override system engaging the exterior end of the shaft, wherein the exterior handle and the override system are both mounted on the exterior end of the shaft; and the shaft being operatively actuated by both the exterior handle and the override system to open the door.

2. The vehicle door of claim 1 wherein the handle assembly includes a lever with a pivot axis for pivotal movement between a pushed in position toward the door and a pulled out position away from the door so as to actuate the power assist unit to close and open the door, respectively.

3. The vehicle door of claim 2 wherein the lever is normally in a neutral position between the pushed in and pulled out positions.

4. The vehicle door of claim 1 wherein the exterior handle assembly and override system share a common mounting hole.

5. The vehicle door of claim 1 wherein the handle assembly includes a lever connected to the shaft by a 360° rack and pinion assembly, and the shaft being operatively connected to the power assist unit.

6. The vehicle door of claim 1 further comprising a latch assembly actuated by pivotal movement of the handle assembly.

7. The vehicle door of claim 1 further comprising a lock assembly actuated by pivot movement of the handle assembly.

8. The vehicle door of claim 1 further comprising a latch assembly which is latched and unlatched by pivotal movement of the handle assembly, and a lock assembly which is locked and unlocked by pivotal movement of the handle assembly.

9. The vehicle door of claim 8 wherein the override system releases the latch and lock assemblies without pivoting the handle assembly.

10. The vehicle door of claim 1 further comprising a control assembly operatively connected between the handle assembly and the power assist unit to actuate the power assist unit upon movement of the handle.

11. The vehicle door of claim 10 wherein the control assembly includes a first actuator to actuate the power assist unit in a first direction to open the door when the handle is pulled and a second actuator to actuate the power assist unit in an opposite second direction to close the door when the handle is pushed.

12. The vehicle door of claim 1 wherein the assembly includes a lever with a hole to receive a lock.

13. A door handle assembly for an armored door, comprising:

a unitary shaft extending into the door and having a single outer end outside the door;

an exterior handle mechanism mounted on the outer end of the shaft to actuate a power assist unit to open the door from outside the vehicle;

an exterior override mechanism mounted on the outer end of the shaft to actuate the power assist unit to open the door from outside the vehicle; and the handle mechanism, override mechanism, and the shaft being configured for mounting onto the door via a single hole in the door;

wherein the shaft is operatively actuated by both the handle mechanism and the override mechanism to open the door.

14. A door handle assembly according to claim 13 wherein both the handle mechanism and the override mechanism share a mutual housing.

15. A door handle assembly according to claim 14 wherein the housing is configured for being fitted within the single hole of the door.

16. A door handle assembly according to claim 14 wherein the handle is configured for revolving about a substantially vertical axis when the door is in a vertical plane.

17. A door handle assembly according to claim 14 wherein the handle is configured for being inwardly pushed and outwardly pulled in a substantially horizontal plane when the door is in a vertical plane.

18. A door handle assembly according to claim 13 wherein the handle mechanism and the override mechanism are configured for operation independently of one another.

* * * * *